United States Patent [19]

Berger, Jr. et al.

[11] 4,003,567

[45] Jan. 18, 1977

[54] SHEET PICK-UP AND FEEDER

[75] Inventors: Emil J. Berger, Jr., Hatfield, Pa.; John M. Mitchard, Cherry Hill, N.J.

[73] Assignee: Union Camp Corporation, Wayne, N.J.

[22] Filed: Apr. 7, 1976

[21] Appl. No.: 674,591

[52] U.S. Cl. ..... 271/12; 271/30 R; 271/90; 271/104; 271/105

[51] Int. Cl.[2] ..... B65H 3/08

[58] Field of Search ..... 271/11, 12, 13, 14, 271/15, 30 R, 31, 104, 105, 90; 214/8.5 D

[56] References Cited

UNITED STATES PATENTS

| | | | |
|---|---|---|---|
| 2,245,836 | 6/1941 | Stobb | 271/31 |
| 3,031,186 | 4/1962 | Galloway | 271/12 |
| 3,466,028 | 9/1969 | Bays | 271/11 |

*Primary Examiner*—John J. Love
*Assistant Examiner*—Bruce H. Stoner, Jr.
*Attorney, Agent, or Firm*—Kane, Dalsimer, Kane, Sullivan and Kurucz

[57] ABSTRACT

Apparatus for picking up a single sheet of semi-rigid material from the top of a stack of such sheets having a device overlying the back end of the stack and holding down that end of the stack, vacuum pick-up shoes to engage the back end of the topmost sheet in the stack, said shoes moving initially to slide the sheet forward from beneath the overlying device and then to lift the back end of the sheet, and a chain conveyor with hooks to engage the raised end of the sheet and feed such sheet into a conveyor for transporting the sheet away from the stack.

6 Claims, 4 Drawing Figures

SHEET PICK-UP AND FEEDER

BACKGROUND OF THE INVENTION

This invention relates to an improvement in sheet pick-up devices and, more particularly, to apparatus for successively picking up single sheets of semi-rigid material, such as corrugated or fiber paperboard, from the top of a stack of such sheets and conveying them away from the stack.

Available apparatus for feeding such sheets frequently is unable to separate only the top sheet from the stack. When more than one sheet is fed there is a danger that they will jam in the machine to which they are being fed. The device of the present invention feeds a single sheet and thus avoids the problem set forth above.

SUMMARY OF THE INVENTION

It is an object of the invention to provide apparatus for picking up a single sheet of semi-rigid material from the top of a stack of such sheets.

It is a further object to pick up one end of a single sheet of semi-rigid material from a stack of such sheets and hold the raised end of such sheet in the path of a conveyor which transports such sheet into means for conveying the sheet away from the stack.

It is a further object to provide apparatus which is simple and economical to manufacture and which is efficient and well suited for its intended purpose.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
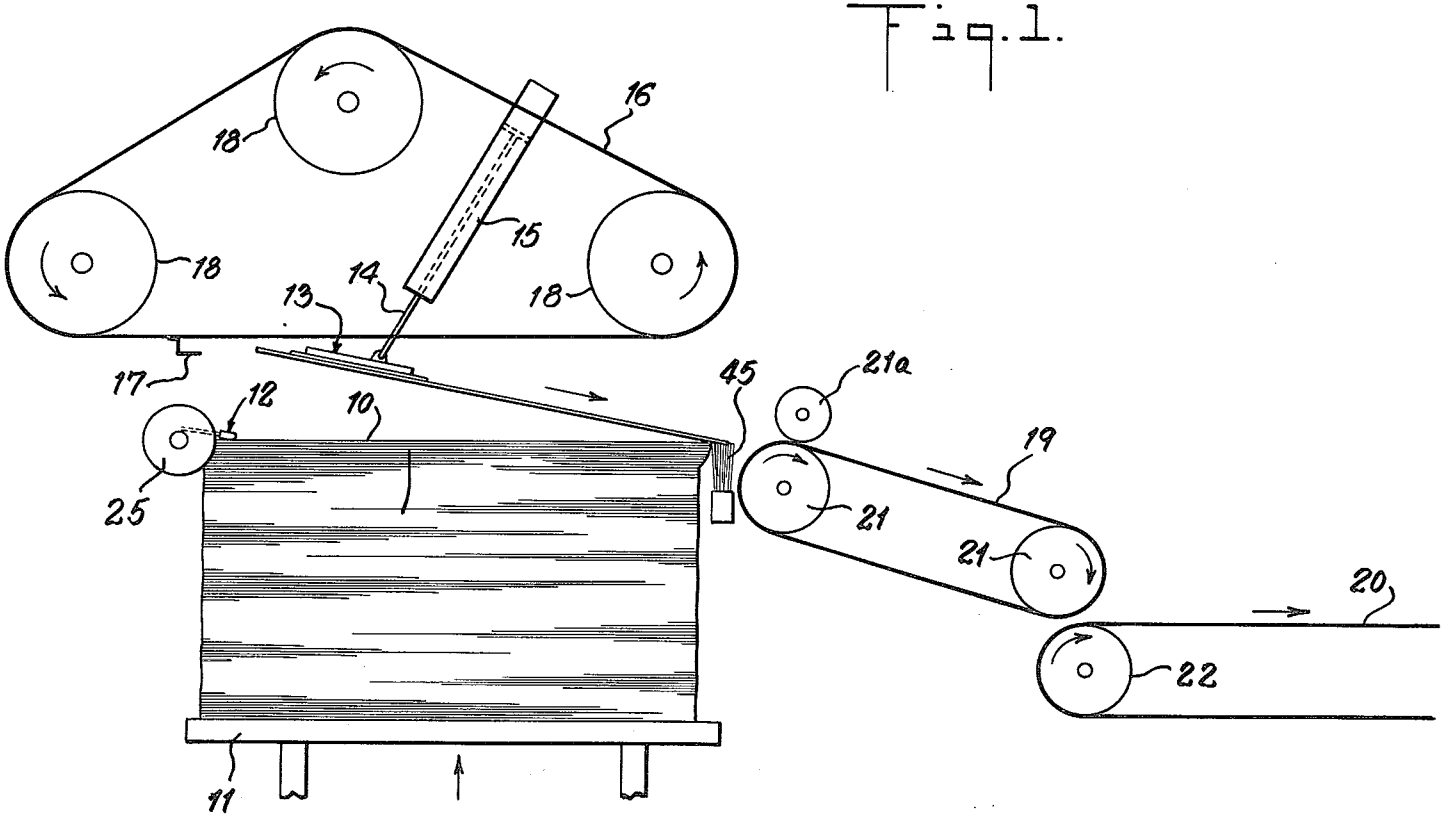
FIG. 1 is a side elevation of the device of the present invention with details of the apparatus omitted, showing the sheet picked up prior to engaging the hooks of a conveyor.

Referring to the drawings, there are shown in FIG. 1 the various elements of the apparatus of the present invention. A stack of semi-rigid sheets 10, such as corrugated board, fiberboard, or like material is piled on a suitable lifting device 11 to maintain the top of the stack at approximately the same level as the sheets are removed from the stack.

At one end of the stack are spaced hold-down devices 12 which are spring loaded to maintain a downward force against that end of the stack. Typical pick-up shoes 13 are each mounted with a pivotal linkage on the rod 14 of lifting means 15, shown as an air cylinder, which is rigidly positioned at an angle with respect to the plane of the top sheet 10 of the stack. Furthermore, the cylinder is so positioned that the pick-up shoe will be brought down at the back end of the stack adjacent the hold-down device 12. The pick-up shoes 13 and air cylinders 15 are positioned along the cross-wise dimension of the stack. The number of such pick-up shoes and hold-down devices varies according to the cross-wise dimension and weight of the sheet.

Adjacent each of the pick-up shoes 13 and air cylinders 15 are chain conveyors 16 provided with feed hooks 17. The chain conveyors are parallel to each other and run over a series of sprocket wheels 18, in the direction of movement of the sheets away from the hold-down devices 12. The feed hooks 17 on the chains 16 are aligned transversely of the direction of feed. The forward movement of the hooks will align the raised sheet 10 transversely and maintain the alignment while transporting the sheet onto suitable belt conveyors 19 and 20 or other means for conveying the sheet away from the stack. The endless belt conveyors 19 and 20 run over pulleys 21 and 22 respectively.

Figure 2:
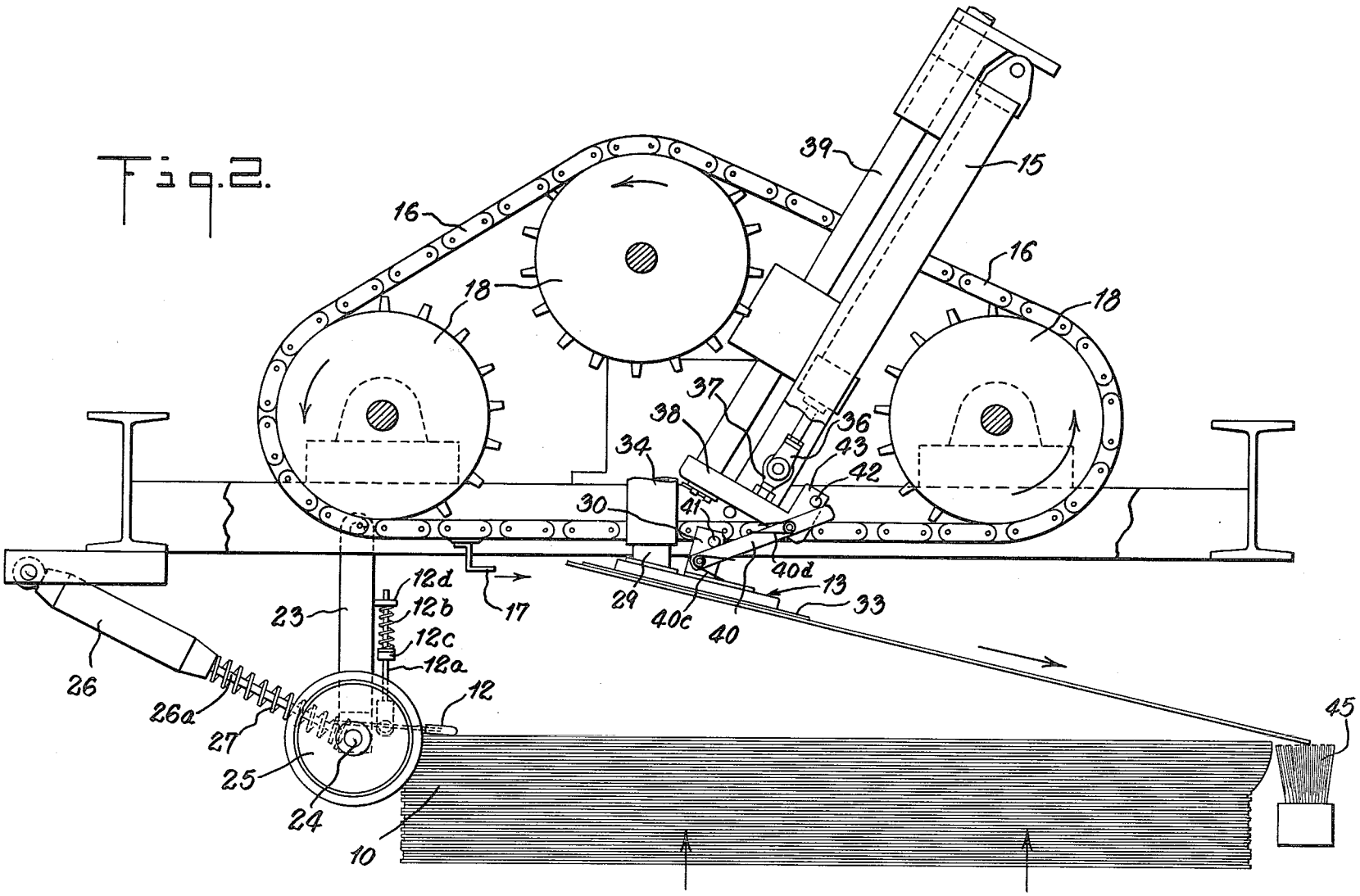
FIG. 2 is a view similar to that of FIG. 1 showing the apparatus in detail.

Referring to FIG. 2, there is a combination hold-down and stop assembly located in line with each pick-up shoe 13 so that the hold-down device 12 contacts the back edge of the top sheet 10 of the stack. Each assembly includes an arm 23 which is pivotally suspended from the frame of the machine. The lower end of the arm 23 contains a shaft 24 on which is mounted a pair of wheels 25. These wheels can be covered with a cushion material, such as urethane, and can rotate freely. Connecting the shaft 24 and the bottom of the frame is a shock absorber consisting of a hydraulic cylinder 26 and a spring 27 over the rod **26*a* of the cylinder 26. As the stack of sheets moves upward to reach the desired level, the back edges of the sheets make contact with the wheels 25. Spring 27 applies force through wheels 25 to urge the top few sheets 10 of the stack forward into contact with brush 45, hereinafter described. The cylinder 26 and spring 27** damp the backward movement of the top sheets during feeding.

Pivotally connected to the shaft 24 of each assembly is the hold-down device 12 which is a curved bar projecting outward from between the wheels 25. A rod **12*a* is pivotally connected at one end to the device 12 and slideably mounted at the other end to a bracket 12*d* affixed to the arm 23. A spring 12*b* is interposed between a collar 12*c* on the rod 12*a* and the bracket 12*d*** to apply an adjustable force downward against the back edge of the stack of sheets.

Figure 3:
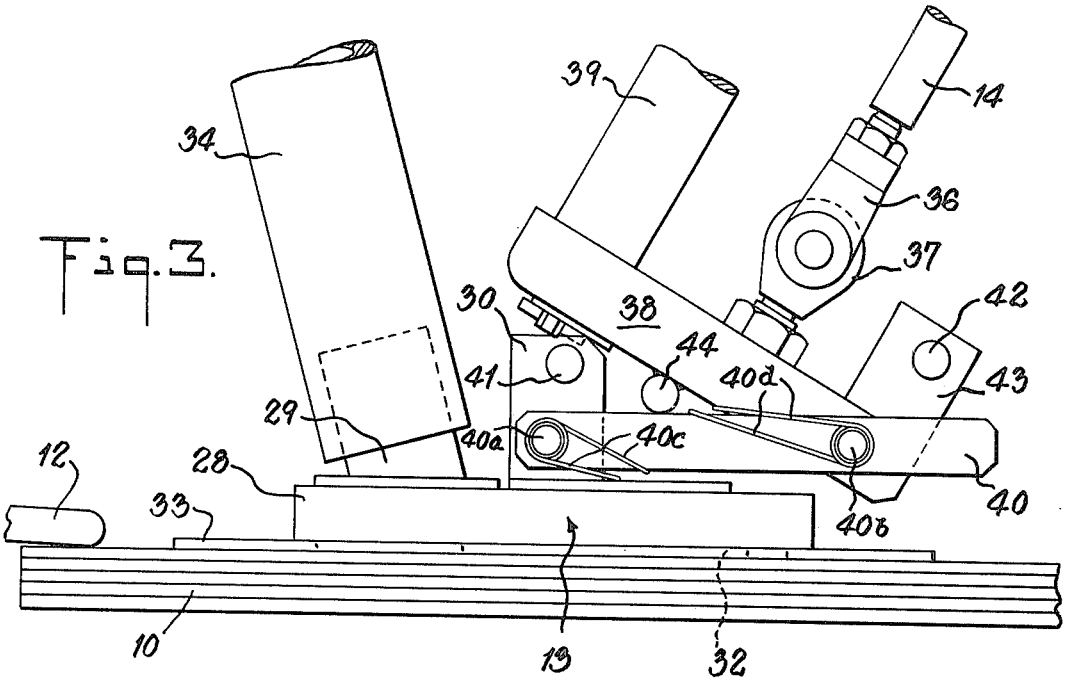
FIG. 3 is a side elevation of the pick-up shoe after it has been brought down against the top sheet of the stack and prior to the application of vacuum.
Figure 4:
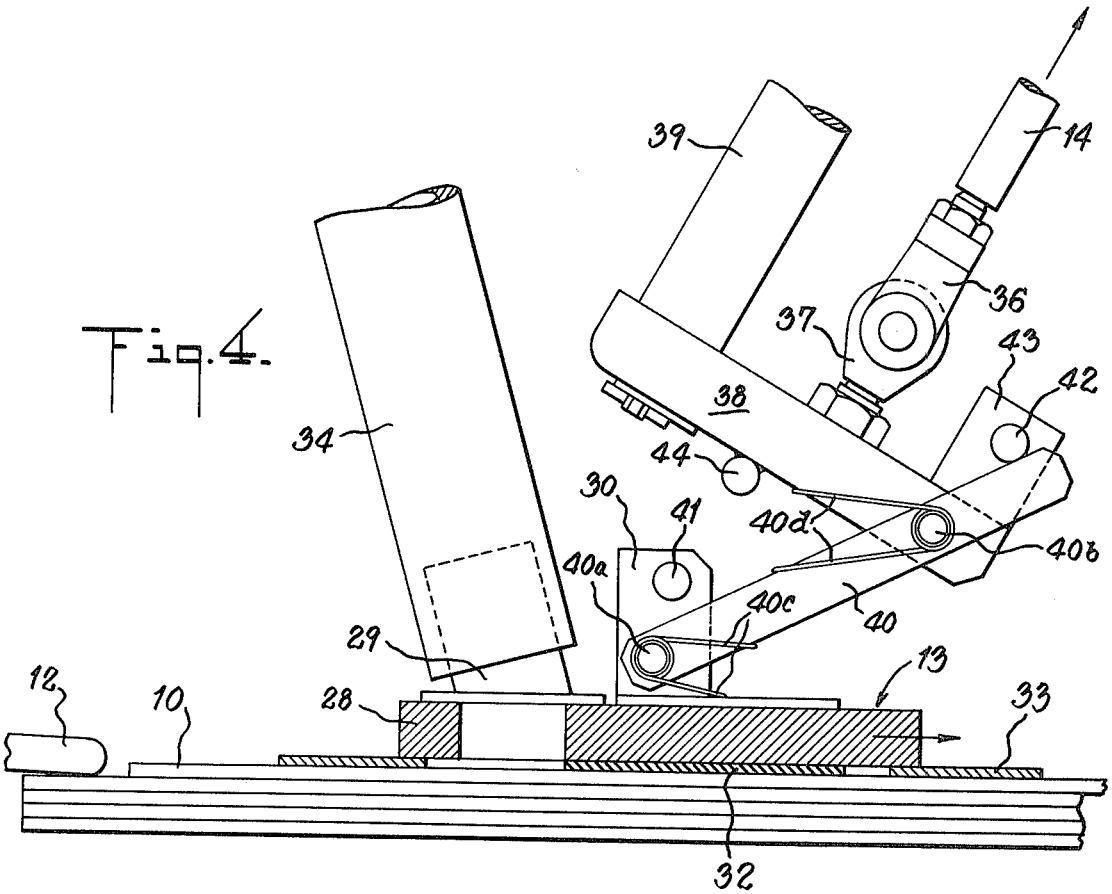
FIG. 4 is a view similar to that of FIG. 3 after the application of vacuum and after the cylinder for raising the shoe has started to retract.

The pick-up shoe 13, shown in FIGS. 3 and 4, is made up of a base plate 28 on top of which are secured a hose connection 29 and a bracket 30. Secured to the bottom periphery of the base plate 28 is a seal 33. A pad 32 of friction material, such as claw-top belting, is bonded to the center position of the base plate 28. The friction pad 32, the seal 33 and the base plate 28 are all provided with openings so that there is a clear passage for air from the vacuum hose connection 29 directly through the pick-up shoe 13 to the top sheet 10 of the stack. A hose 34 connected to a source of vacuum is affixed to the hose connection 29.

The pick-up shoe 13 is connected by a linkage 35 to the cylinder 15. This cylinder is mounted to the frame of the machine at an angle so that it is tilted in the direction of the flow of sheets 10 from the stack. The rod 14 of the cylinder 15 moves plate 38 through coupling 36 which is pivotally secured by a knuckle 37 which is attached to the plate 38. Also affixed to the plate 38 is a support rod 39 which is positioned parallel to the cylinder 15 so that the rod 14 of the cylinder and the rod 39 will carry the plate 38 in a fixed path toward or away from the top of the stack. The bracket 30 projects upward from plate 28. A link 40 is positioned on each side of the shoe with one end pivotally connected to the bracket 30 and the other end pivotally connected to the side of the plate 38. A pin 41 is secured to bracket 30 to limit the rotation of the plate 28 about pivot 40*a*. A similar pin 42 is secured to bracket 43 which is affixed to plate 38 to likewise limit the rotation of the link 40 about pivot 40*b*. A spring 40*c* urges plate 28 in the clockwise direction about pivot 40*a* until links 40 reach the limit set by pin 41. A spring 40*d* urges links 40 in the counterclockwise direction about pin pivot 40*b* until they reach the limit set by pin 42. A pin 44 is affixed to the bottom of the plate 38 to act as a clockwise limit for the rotation of links 40, as shown in FIG. 3.

In operation, the stack of sheets 10 is raised by lifting device 11 to the operating height, which is approximately in line with the top of the bristles of brush 45 and the shafts 24 of wheels 25. The stack pushes against wheels 25 as it rises, compressing springs 27. The force of compressed springs 27 through wheels 25 pushes the top few sheets 10 of the stack forward against brush 45. The control system causes the cylinders 15 to extend downward and force pick-up shoes 13 against the top surface of the stack until links 40 contact stops 44. At this time plates 28 have assumed their most rearward position adjacent the hold-down devices 12 because of the rotation of links 40 about pivots 40*b*. Wheels 25 prevent any rearward motion of the top sheets 10 on the stack. The control system then causes vacuum to be applied through hose 34.

During the initial retraction of cylinders 15 the weight of the top sheet 10 from the stack, now attached by suction to plate 28, causes links 40 to rotate away from the plates 38. Cylinders 15 are mounted at an angle relative to the plane of the top of the stack so that there is a component of its travel in the direction of the arrow in FIG. 4. As cylinders 15 retract the rotation of links 40 allowing plates 28 to move in the direction of the arrow in FIG. 4 until links 40 contact pins 42, at which time the top sheet has been pulled from under hold-down devices 12. Friction pads 32 preclude relative motion between plates 28 and the sheet to which they are attached. The sheets below the top sheet 10 in the stack are restrained from moving forward by brush 45 which is positioned across the leading edge of the stack. It will be understood that flexible fingers or other like means may be employed to perform the same function (such means being referred to hereinafter as "flexible projections"). When links 40 contact pins 42 the plates 28, carrying the top sheet, begin to move upward at the angle of cylinders 15. As the top sheet 10 of the stack lifts rapidly from the lower sheets a vacuum is created and tends to pull these lower sheets along with the top sheet. Hold-down devices 12 prevent this upward movement of the lower sheets. Cylinders 15 continue to retract until the back edge of the top sheet 10 has been raised to the underside of the frame as shown in FIG. 2. The weight of the sheet 10 attached to plates 28 has caused plates 28 to rotate about pivot 40*a* so that sheet 10 hangs from plates 28 with its forward edge supported by brush 45, awaiting the arrival of feed hooks 17. As the leading edges of feed hooks 17 move under the back edge of sheet 10 the control system causes the release of sheet 10 from plates 28. The back edge of sheet 10 drops into hooks 17 which carry it forward into the nip between belts 19 and rolls 21*a*. The speed of belts 19 is greater than the speed of chains 16 causing the back edge of sheet 10 to be withdrawn from hooks 17 as hooks 17 move forward, thereby allowing hooks 17 to move, without interference from sheet 10 with chains 16 about sprockets 18 to begin another cycle.

The sheet may be further conveyed from belts 19 to another belt conveyor 20. The step of transporting the sheet from the feeding device is a matter of preference and may be varied to suit particular needs. The transporting operation does not form a part of the present invention.

Thus among others, the several aforenoted objects and advantages are most effectively attained. Although a somewhat preferred embodiment of the invention has been disclosed and described in detail herein, it should be understood that the invention is in no sense limited thereby and its scope is to be determined by that of the appended claims.

Having thus described the invention, what is claimed is:

1. Apparatus for picking up a single sheet of semi-rigid material from the top of a stack of such sheets and transporting the sheet in a forward direction away from the stack comprising:

a support for the stack of sheets having lifting means;

hold-down means to maintain a downward force against the top of the stack at the back edge of the stack;

a pick-up shoe having a seal around the outer periphery of the shoe to maintain a vacuum within the seal;

the said shoe being positioned and adapted under vacuum to pick up the back end of the top sheet of the stack;

means for applying a vacuum through the said shoe;

raising and lowering means for the said shoe;

linkage between the said raising and lowering means and the said shoe, the said linkage, when the vacuum means and raising means are activated, imparting an initial sliding movement of the shoe and top sheet along the top of the stack to release the said top sheet from the hold-down means and then raising the back edge of the top sheet;

flexible projections along the front edge of the stack to prevent forward motion of the subsequent sheets in the stack; and means moving forward above the stack to engage the raised back edge of the said top sheet;

whereby the said top sheet will be transported away from the said stack.

2. The apparatus of claim 1 wherein the said raising and lowering means for the said shoe comprises an air cylinder positioned at an angle toward the forward end of the said stack.

3. The apparatus of claim 1 wherein the said means engaging the raised back edge of the top sheet are hooks applied to parallel conveyor chains running above the said stack in a forward direction, the said hooks being aligned in a cross machine direction to engage the back edge of the said top sheet.

4. The apparatus of claim 1 wherein such apparatus comprises a relatively stiff brush positioned along the forward edge of the said stack at a height approximately level with the top of the said stack, whereby the said brush will restrain sheets below the top sheet from moving forward.

5. The apparatus of claim 1 wherein each shoe and linkage comprises a first plate affixed to the said raising and lowering means, and links pivotally connecting the said plate to the said pick-up shoe, the said links imparting the said sliding and raising motion from the first plate to the pick-up shoe and gripped top sheet.

6. The apparatus of claim 1 wherein the pick-up shoe comprises a friction pad with the said seal around the periphery of the shoe.

* * * * *